United States Patent [19]

Purkapile

[11] Patent Number: 4,773,503

[45] Date of Patent: Sep. 27, 1988

[54] LADDER HINGE

[75] Inventor: Emerson J. Purkapile, Chicago, Ill.

[73] Assignees: Robert L. Pease, Scarsdale; Kenneth T. Feeser, Amityville, both of N.Y.

[21] Appl. No.: 96,425

[22] Filed: Sep. 11, 1987

[51] Int. Cl.[4] ..... E06C 1/383; E06C 1/08

[52] U.S. Cl. ..... 182/22; 182/163; 403/97; 16/323

[58] Field of Search ..... 182/163, 164, 24, 23, 182/2 X; 403/97, 92; 16/324, 326, 328

[56] References Cited

U.S. PATENT DOCUMENTS

| | | | |
|---|---|---|---|
| 1,800,349 | 4/1931 | Hurason | 403/97 |
| 3,412,420 | 11/1968 | Seckerson | 16/146 |
| 3,545,786 | 12/1970 | Yeder | 403/97 |
| 3,586,355 | 6/1971 | Magi | 287/14 |
| 3,643,292 | 2/1972 | Mayer | 16/144 |
| 3,655,012 | 4/1972 | Hoffman et al. | 187/163 |
| 3,779,655 | 12/1973 | Toyota | 403/93 |
| 3,811,151 | 5/1974 | Kuemmerlin | 16/144 |
| 3,811,715 | 5/1974 | Brudy | 403/93 |
| 3,847,488 | 11/1974 | Gossage | 403/79 |
| 3,861,499 | 1/1975 | Follett, Jr. | 182/163 |
| 3,879,146 | 4/1975 | Mayer | 403/93 |
| 3,904,298 | 9/1975 | Lindgren | 403/93 |
| 3,955,240 | 5/1976 | Schuh et al. | 16/144 |
| 4,070,058 | 1/1978 | Muehling | 297/374 |
| 4,089,084 | 5/1978 | Droz | 16/128 R |
| 4,152,810 | 5/1979 | Martinez | 16/144 |
| 4,157,128 | 6/1979 | Peters | 182/24 |
| 4,216,844 | 8/1980 | Klafs | 182/104 |
| 4,226,549 | 10/1980 | Batt | 403/92 |
| 4,236,753 | 12/1980 | Ooshiro et al. | 297/364 |
| 4,290,168 | 9/1981 | Binge | 16/175 |
| 4,335,625 | 6/1982 | Nishikawa | 74/493 |
| 4,403,373 | 9/1983 | Kummerlin | 16/327 |
| 4,407,045 | 10/1983 | Boothe | 16/327 |
| 4,428,458 | 1/1984 | Fiore et al. | 182/116 |
| 4,474,264 | 10/1984 | Krause | 182/163 |
| 4,540,306 | 9/1985 | Wang | 403/93 |
| 4,543,006 | 9/1985 | Wang | 403/93 |
| 4,543,007 | 9/1985 | Quiogue | 403/97 |
| 4,566,150 | 1/1986 | Boothe | 16/332 |
| 4,577,986 | 3/1986 | Wang | 403/93 |
| 4,602,889 | 7/1986 | Mu-Shan | 403/91 |
| 4,614,452 | 9/1986 | Wang | 403/97 |
| 4,653,371 | 2/1987 | Wang | 403/93 |

OTHER PUBLICATIONS

Brochure–Flex-o-Ladder® Pro–The Difference in Safe, Reliable, Dependable and Convenient Performance," (pub. by Tool America, Inc. 1987).

*Primary Examiner*—Reinaldo P. Machado
*Attorney, Agent, or Firm*—Pennie & Edmonds

[57] ABSTRACT

A hinge for connecting and adjustably holding two sections of a supporting element such as ladder segments in an angular orientation with respect to each other comprising a housing having at least two halves rotatable with respect to each other about an axis of rotation, a first half for holding one of the sections and a second for holding the other section; means for mounting the housing halves for movement linearly along the axis of rotation between first and second positions along the axis of rotation; and a plurality of mating teeth on each housing half which engage to prevent rotation of the housing halves when the housing halves are in the first position while permitting rotation of the housing halves when the housing halves are in the second position. The hinge also includes biasing means in the form of a rod and cam arrangement for biasing the housing halves into the first position.

28 Claims, 3 Drawing Sheets

LADDER HINGE

TECHNICAL FIELD

The present invention relates to an improved ladder hinge and locking mechanism therefor, and more particularly to a ladder hinge that has a plurality of locking positions and is structurally sound.

BACKGROUND ART

Ladders are commonly used for a variety of applications and are of two general types. One type is a folding ladder, commonly called a step ladder, which is self supporting. Step ladders are typically used for such tasks as pruning, painting ceilings, or other similar tasks where it may be impossible to lean the ladder against a structure for support. The other type of ladder which is well known is the straight extension ladder. This type of ladder is simply leaned against the wall or some other structure when standing or climbing on the ladder.

Ladders which are constructed so that they may be used as both step ladders and as straight extension ladders have long been known in the art. Typically, such ladders are constructed with hinges in the middle of the side rails. The hinges permit the ladder to be folded into a step ladder configuration or unfolded into a straight extension ladder configuration. Such ladders, commonly referred to as combination step and extension ladders, are very versatile and they combine the desirable features of both types of ladders.

Further improvements on such step ladders include foldable ladders or ladders which are adjustable to a variety of positions so that they can be used as scaffolding or for other support configurations. Such foldable or adjustable ladders include two or more adjustable locking hinges which enable the ladder to conform to the desired positions. A wide variety of adjustable locking hinges are known in the prior art.

The applicant has now developed a novel and improved hinge mechanism for use in such adjustable ladders, as will be detailed in the following description.

SUMMARY OF THE INVENTION

The present invention relates to a hinge for connecting and adjustably holding two sections of a supporting element in an angular orientation with respect to each other comprising a housing means having at least two halves rotatable with respect to each other about an axis of rotation, a first half for holding one of the sections and a second for holding the other section; mounting means for mounting the housing halves for movement linearly along the axis of rotation between a first position along the axis of rotation and a second position along the axis of rotation; and interengaging means for preventing rotation of the housing halves when the housing halves are in the first position and permitting rotation of the housing halves when the housing halves are in the second position. Either one of the housing halves, or both, can include a mounting bracket for mounting to one of the sections.

Preferably, the hinge also includes biasing means for biasing the housing halves into the first position. The biasing means comprises a rod extending from the first housing half in a direction parallel to the axis of rotation, through an opening defined in a surface of the second housing half; and a cam engaging the surface and movable between a first position biasing the housing halves into their first position and a second position permitting movement of the housing halves to their second position.

The interengaging means of the invention may have a first set of adjacent ridges with a depression between each pair of adjacent ridges on the first housing half, where the apexes of the ridges point in a direction parallel to the axis of rotation; a second set of adjacent ridges on the second housing half also having a depression between each pair of adjacent ridges, and the apexes of the ridges extending parallel to the axis of rotation. The second set of ridges is located adjacent the apexes of the first set of ridges so that they are received in the depressions of the first set of ridges with the depressions of the second set of ridges receiving the apexes of the first set of ridges when the housing halves are in their first position. Advantageously, the first and second sets of ridges and depressions are mating teeth positioned to interengage when the housing halves are in their first position and which are disengaged when the housing halves are in their second position.

The biasing means can also include a support extending from the first housing half in a direction parallel to the axis of rotation; and a cam pivotably mounted on the support and engaging a surface of the second housing half, the cam being pivotable between a first position urging the housing halves in their first position and a second position permitting movement of the housing halves to their second position. Preferably, the cam is made of nylon and has a lever to facilitate manual movement between its first and second position.

The hinge may further include formations on an outer surface of one of the housing halves for engaging a stop block is movably mounted to the other of the housing halves. The stop block is movable between a first position where it engages the formation to prevent relative rotation of the housing halves in one direction about the axis and a second position not engaged with the formation. The stop block is mounted to a spring steel member extending from the other housing half, so that the spring steel member biases the stop block into its first position.

The invention also relates to a multi-purpose ladder capable of assuming a plurality of configurations comprising at least two ladder portions each having first and second stringers and a plurality of rungs, where the respective first and second stringers of each ladder portion are each connected by the previously described hinge to facilitate pivotal movement of the stringers about a pivot axis and to releasably lock the ladder portions in any one of a the plurality of angular relationships.

BRIEF DESCRIPTION OF THE DRAWINGS

Preferred embodiments of the invention are described hereinbelow with reference to the drawing figures wherein.

DETAILED DESCRIPTION OF THE INVENTION

Figure 1:
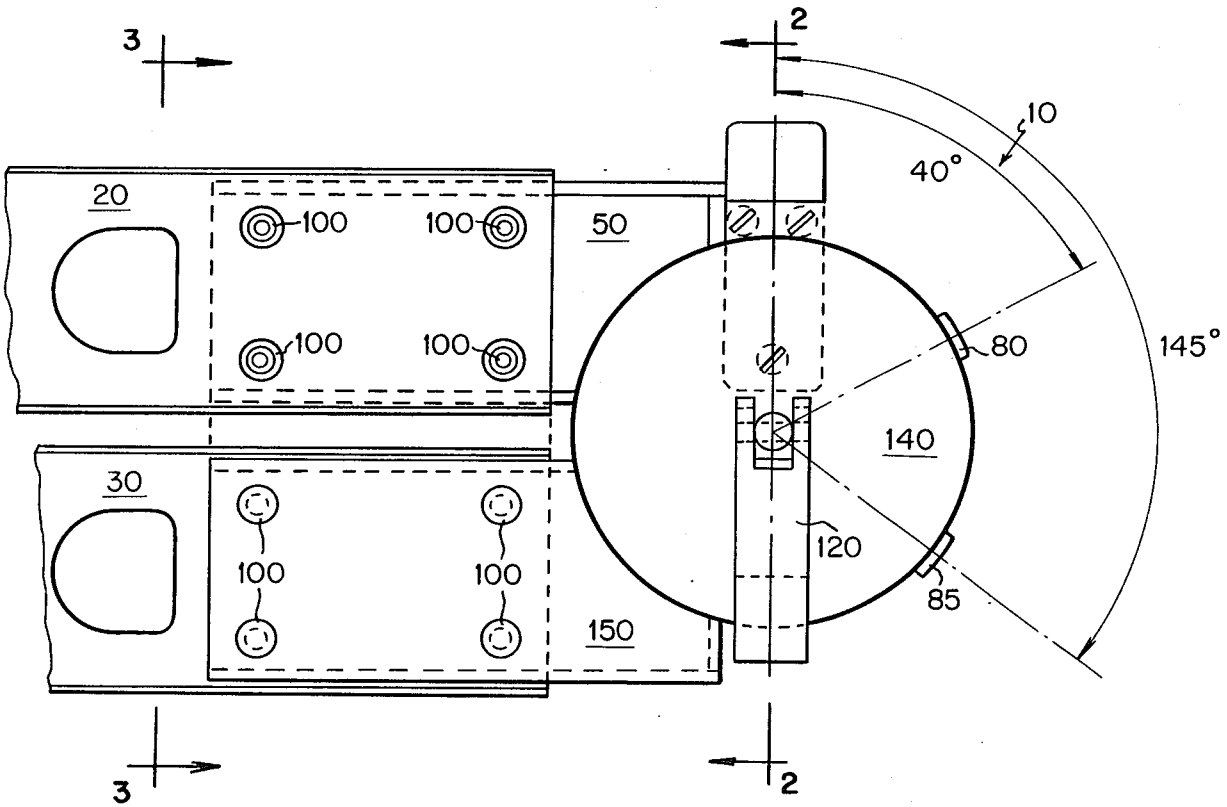
FIG. 1 is a side view of a hinge according to the invention.

FIG. 1 is an illustration of a hinge 10 according to the invention for use in joining and holding two structural members together at a predetermined angular orientation. The preferred use for hinge 10 is coupling together two ladder stringers 20,30. Thus, by utilizing two of such hinges 10, to join respective first and second stringers of two ladder portions, a multi-purpose ladder is obtained. As one skilled in the art would realize, three, four or even more ladder portions can be included in the multi-purpose ladder, with the first and second stringers of each ladder portion each being connected to the respective first and second stringers of an adjacent ladder portion by hinges 10 of the invention. Such multiple section ladders can form and be maintained in a wide variety of configurations for use as scaffolding or other support structures. In addition, the multi-purpose ladder can be configured as a stepladder or as a straight extension ladder.

The inventive hinge 10 is composed of two symmetric circular housing halves 40,140, each having a mounting bracket for mounting ladder stringers 20,30 thereto by attachment means, namely screws (if wooden ladder portions are used) or rivets (for metal ladder portions) which pass through apertures 60,160 in the mounting brackets 50,150. As shown in FIG. 1, aluminum ladder stringers 20,30 are preferred, and rivets 100 are utilized to attach the mounting brackets to the stringers.

Figure 4:
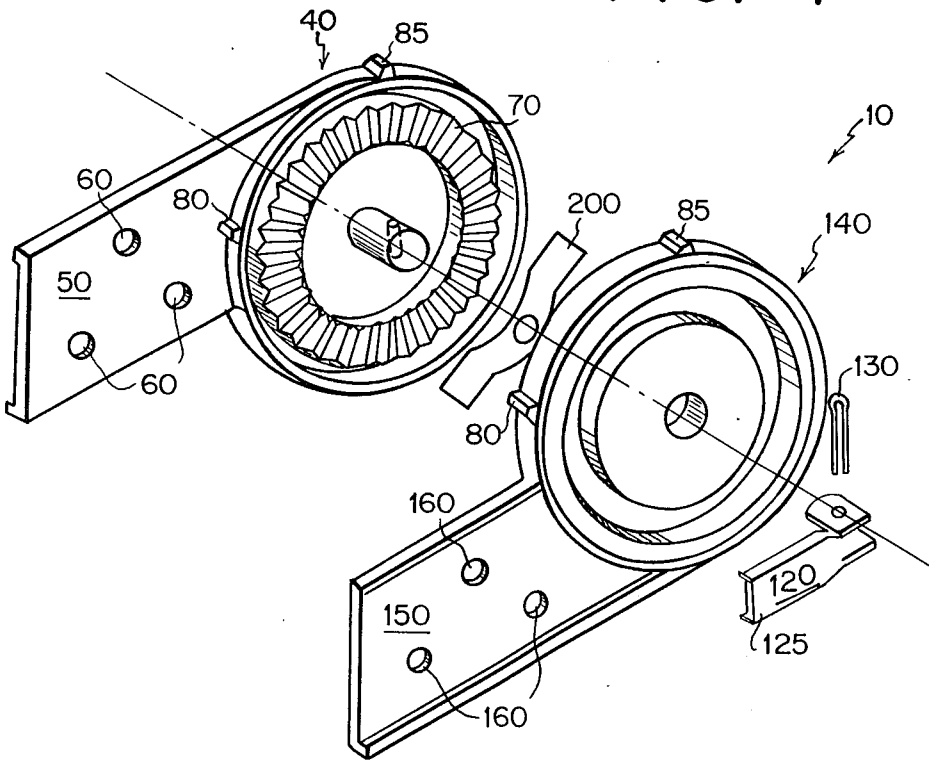
FIG. 4 is an exploded perspective view of the hinge of FIG. 1 to illustrate its component parts.

As best illustrated in FIG. 4, the housing halves each contain a circular array of teeth 70,170 extending radially around the center of the halves. These teeth matingly engage when the halves are brought together with the apexes of the teeth of one housing half fitting in the depressions formed between the apexes of the teeth on the other housing half. When brought together, the housing halves cannot rotate with respect to one another, so that the ladder stringers are maintained at a particular angle, which can vary depending upon the number of teeth provided on each housing half. For example, if 30 equal sized teeth are provided, then the ladder stringers can assume any angle from 0° to 340° in 20° increments. The number of teeth can vary depending upon the precision needed for the angular relation between the stringers or ladder portions.

Usually, a certain limited number of angular orientations are preferred, such as, for example 40°, 145°, and 180° from the vertical. The present hinge provides an assembly for easily positioning the ladder stringers at these orientations. This assembly includes a plurality of stop blocks 80,85 which are located at the desired angles of 40° and 145° (with respect to vertical), along with spring member 90, a flat section of spring steel, and pin stop 95, the operation of which will be described hereinbelow. One skilled in the art can provide as many stop blocks as necessary, while applicant has presently found that between two and four, preferably three, are sufficient for most multi-purpose ladder applications.

Figure 3:
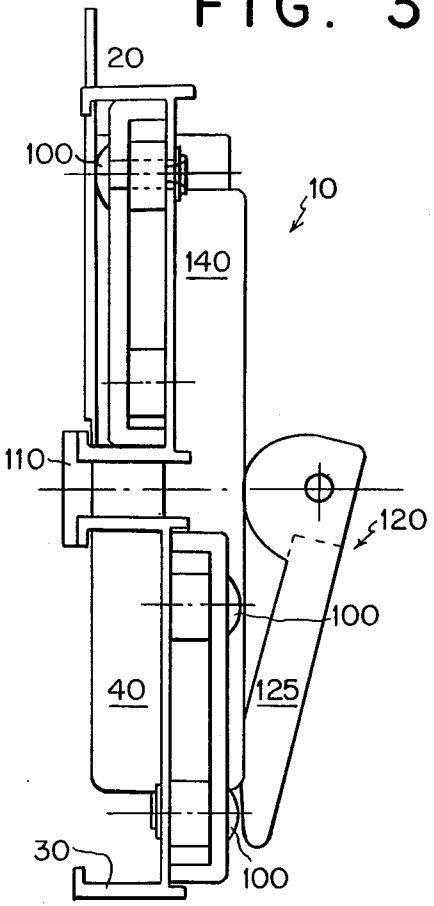
FIG. 3 is a side view of the hinge taken along line 3—3 of FIG. 1.
Figure 2:
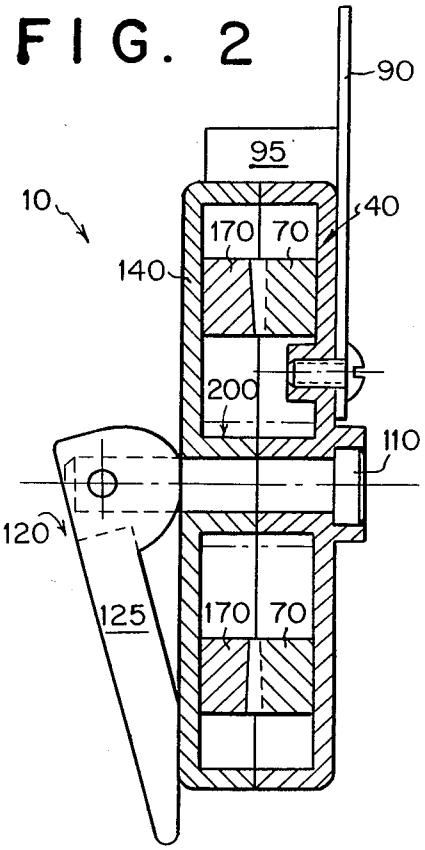
FIG. 2 is a cross sectional view taken along lines 2—2 of FIG. 1.

The housing halves 40,140 are maintained in the engaged position by the use of a novel pin and cam lock arrangement, and this maintains the stringers at the desired angle. Pin 110 extends through the center of each housing half 40,140, for connection to cam lock 120 by cotter pin 130. By placing the cam lock 120 in a locking or closed position, as best illustrated in FIGS. 2 and 3, the two housing halves are pushed together by the pin 110 and cam lock 120, so that the stringers cannot change their angular orientation. The cam lock 120 will retain the stringers at the precise angle until it is moved to an unlocked or open position.

The lever 125 of the cam lock 120 is pulled upward until it extends in the same direction as pin 110. Then, due to the shape of the cam surface, the closing forces exerted by pin 110 and cam lock 120 are released, so that the housing halves may separate by slightly moving away from each other. Cotter pin 130 allows the cam lever 125 to be opened and closed, but maintains the connection between the pin 110 and the cam lock 120 so that the housing halves do not fall away from each other. In this arrangement, the cam lock 120 can be molded from an engineering thermoplastic, such as nylon, while pins 110 and 130 are made of a suitable metal such as steel or aluminum.

To assist in separating the housing halves when the forces are released by opening the cam lever 125, a small spring 200, preferably of a bent strip of spring steel, is mounted on pin 110 between the housing halves such that, when the housing halves are brought together the spring 200 is compressed. Thus, when the cam lock 120 is released, spring 200 provides sufficient force to separate the housing halves so that they can freely rotate around pin 110. To obtain one of the preset angles, the halves are rotated until stop pin 95 hits the appropriate stop block. To rotate the housings beyond the first stop block 80, spring membr 90 is pulled back (in the same direction as the cam lever) so that the stop pin 95 can move around stop block 80. After clearing the stop block 80, the spring member 90 is returned to its original position and the housing halves continue to rotate until stop pin 95 engages the next stop block 85.

The inventive hinge is thus ideally suited for simply and rapidly adjusting the angle between ladder portions or stringers to predetermined positions in a convenient and easy operation, thus providing significant advantages over prior art hinges.

While it is apparent that the invention herein disclosed is well calculated to fulfill the objects above stated it will be appreciated that numerous modifications and embodiments may be devised by those skilled in the art, and it is intended that the appended claims cover all such modifications and embodiments as fall within the true spirit and scope of the present invention.

What is claimed is:

1. A hinge for connecting and adjustably holding two sections of a supporting element in an angular orientation with respect to each other comprising:

a housing means having at least two halves rotatable with respect to each other about an axis of rotation, a first half for holding one of said sections and a second half for holding the other section;

means for mounting said housing halves for movement linearly along said axis of rotation between first and second positions along said axis of rotation; and interengaging means for preventing rotation of said housing halves when said housing halves are in said first position and permitting rotation of said housing halves when said housing halves are in said second position;

wherein an outer surface of one of said housing halves includes formations thereon for engaging a stop block; and further wherein the other of said housing halves has mounted thereon a stop block movable between a first position where it engages said formations to prevent relative rotation of the housing halves in one direction about said axis and a second position not engaged with said formations which permits free rotation of the housing halves along the axis of rotation.

2. The hinge according to claim 1 wherein a first of said housing halves includes a bracket for mounting one of said sections and a second of said housing halves includes a bracket for mounting the other of said sections.

3. The hinge according to claim 1 further comprising biasing means for biasing said housing halves into said first position.

4. The hinge according to claim 3 wherein said biasing means comprises:

a rod extending from said first housing half in a direction parallel to said axis of rotation, through an opening defined in a surface of said second housing half; and a cam engaging said surface and movable between a first position biasing said housing halves into their first position and a second position permitting movement of said housing halves to their second position.

5. The hinge according to claim 4 wherein said interengaging means comprises:

a first set of adjacent ridges on said first housing half having a depression between adjacent ridges, the apexes of said ridges pointing in a direction parallel to said axis of rotation;

a second set of adjacent ridges on said second housing half adjacent the apexes of said ridges having a depressions between adjacent ridges extending parallel to said axis of rotation and being received in the depressions of the first set of ridges when said housing halves are in their first position, the depressions of said second set of ridges receiving the apexes of the first set of ridges.

6. The hinge according to claim 5 wherein said first and second sets of ridges and depressions are mating teeth.

7. A multi-purpose ladder capable of assuming a plurality of configurations comprising at least two ladder portions each having first and second stringers and a plurality of rungs; the respective first and second stringers of each ladder portion being connected by the hinge of claim l to facilitate pivotal movement of said stringers about a pivot axis and to releasably lock said ladder portions in any one of a plurality of angular relationships therebetween.

8. A hinge for connecting and adjustably holding two sections of a supporting element in angular orientation with respect to each other comprising:

a first housing half having a bracket for mounting a portion of one of said sections;

a second housing half movably mounted to said first housing half, and having a bracket for mounting a portion of the other of said sections;

means for movably mounting said first and second housing halves for rotation with respect to each other about a predetermined axis of rotation and for linear movement with respect to each other along said axis of rotation;

interengaging means for preventing rotation of said first and second housing halves when said housing halves are in a first position with respect to one another along said axis of rotation and permitting rotation of said housing halves when said housing halves are in a second position along said axis of rotation;

means for biasing said housing halves into said first position when said biasing means are engaged and permitting movement of said housing halves to said second position when said biasing means is disengaged; and means for positioning said housing halves at one of a plurality of predetermined angular reltionships therebetween, said positioning means mounted to one of said housing halves and capable of engaging the outer surface of said other housing half so that said positioning means in a first position normally prevents relative rotation between said halves by engaging the outer surface of said other housing half, and in a second position does not engage said outer surface of the other housing half to permit angular rotational movement between the housing halves.

9. The hinge according to claim 8 wherein said interengaging means includes a first set of teeth on said first housing half and a second set of mating teeth on said second housing half which teeth are positioned to interengage when said housing halves are in their first position and disengaged when said housing halves are in their second position.

10. The hinge according to claim 9 wherein said biasing means includes:

a support extending from said first housing half in a direction parallel to said axis of rotation; and a cam pivotably mounted on said support and engaging a surface of said second housing half, said cam being pivotable between a first position urging said housing halves in their first position and a second position permitting movement of the housing halves to their second position.

11. The hinge according to claim 10 wherein said cam is made of nylon and further includes a lever to facilitate manual movement between its first and second position.

12. A multi-purpose ladder capable of assuming a plurality of configurations comprising at least two ladder portions each having first and second stringers and a plurality of rungs; the respective first and second stringers of each ladder portion being connected by the hinge of claim 8 to facilitate pivotal movement of said stringers about a pivot axis and to releasably lock said ladder portions in any one of a plurality of angular relationships therebetween.

13. A hinge for connecting and adjustably holding two sections of a supporting element in angular orientation with respect to each other comprising:

a first housing half having a bracket for mounting a portion of one of said sections;

a second housing half movably mounted to said first housing half, and having a bracket for mounting a portion of the other of said sections;

means for movably mounting said first and second housing halves for rotation with respect to each other about a predetermined axis of rotation and for linear movement with respect to each other along said axis of rotation;

interengaging means for preventing rotation of said first and second housing halves when said housing halves are in a first position with respect to one another along said axis of rotation and permitting rotaton of said housing halves when said housing halves are in a second position along said axis of rotation;

means for biasing said housing halves into said first position when said biasing means are engaged and permitting movement of said housing halves to said second position when said biasing means is disengaged;

formations on an outer surface of one of said housing halves for engaging a stop block; and a stop block movably mounted to the other of said housing halves, said stop block movable between a first position where it engages said formation to prevent relative rotation of the housing halves in one direction about said axis and a second position not engaged with said formation.

14. The hinge according to claim 13 wherein said stop block is mounted to a spring steel member extending from said other housing half, said spring steel member biasing said stop block into its first position.

15. A multi-purpose ladder capable of assuming a plurality of configurations comprising at least two ladder portions each having first and second stringers and a plurality of rungs; the respective first and second stringers of each ladder portion being connected by the hinge of claim 13 to facilitate pivotal movement of said stringers about a pivot axis and to releasably lock said ladder portions in any one of the plurality of angular relationships therebetween.

16. A hinge for connecting and adjustably holding two sections of a supporting element in angular orientation with respect to each other comprising:

a first housing half having a bracket for mounting a portion of one of said sections;

a second housing half movably mounted to said first housing half, and having a bracket for mounting a portion of the other of said sections;

means for movably mounting said first and second housing halves for rotation with respect to each other about a predetermined axis of rotation and for linear movement with respect to each other along said axis of rotation;

interengaging means comprising a first set of teeth on said first housing half and a second set of mating teeth on said second housing half which teeth interengage to prevent rotation of said first and second housing halves when said housing halves are in a first position with respect to one another along said axis of rotation and disengage to permit rotation of said housing halves when said housing halves move toward a second position along said axis of rotation; and means for biasing said housing halves into said first position when said biasing means are engaged and for permitting movement of said housing halves to said second position when said biasing means is disengaged, comprising a support extending from said first housing half in a direction parallel to said axis of rotation; and a cam pivotably mounted on said support and engaging a surface of said second housing half, said cam being pivotable between a first position urging said housing halves in their first position and a second position permitting movement of the housing halves to their second position, said cam being made of nylon and having a lever to facilitate manual movement between its first and second position; and wherein an outer surface of one of said housing halves includes formations thereon for engaging a stop block; and further wherein the other of said housing halves has mounted thereon a stop block movable between a first position where it engages said formations to prevent relative rotation of the housing halves in one direction about said axis and a second position not engaged with said formation which permits free rotation of the housing halves along the axis of rotation.

17. The hinge according to claim 16 wherein said stop block is mounted to a spring steel member extending from said other housing half, said spring steel member biasing said stop block into its first position.

18. A multi-purpose ladder capable of assuming a plurality of configurations comprising at least two ladder portions each having first and second stringers and a plurality of rungs; the respective first and second stringers of each ladder portion being connected by the hinge of claim 16 to facilitate pivotal movement of said stringers about a pivot axis and to releasably lock said ladder portions in any one of the plurality of angular relationships therebetween.

19. A hinge for connecting and adjustably holding two sections of a supporting element in an angular orientation with respect to each other comprising:

a housing means having at least two halves rotatable with respect to each other about an axis of rotation, a first half for holding one of said sections and a second half for holding the other section;

means for mounting said housing halves for movement linearly along said axis of rotation between first and second positions along said axis of rotation;

interengaging means for preventing rotation of said housing halves when said housing halves are in said first position and permitting rotation of said housing halves when said housing halves are in said second position; and means for positioning said housing halves at one of a plurality of predetermined angular relationships therebetween, said positioning means mounted to one of said housing halves and capable of engaging the outer surface of said other housing half so that said positioning means in a first position normally prevents relative rotation between said halves by engaging the outer surface of said other housing half, and in a second position does not engage said outer surface of the other housing half to permit angular rotational movement between the housing halves.

20. The hinge according to claim 19 wherein a first of said housing halves includes a bracket for mounting one of said sections and a second of said housing halves includes a bracket for mounting the other of said section.

21. The hinge according to claim 20 further comprising biasing means for biasing said housing halves into said first position.

22. The hinge according to claim 21 wherein said biasing means comprises:

a rod extending from said first housing half in a direction parallel to said axis of rotation, through an opening defined in a surface of said second housing half; and a cam engaging said surface and movable between a first position biasing said housing halves into their first position and a second position permitting movement of said housing halves to their second position.

23. The hinge according to claim 22 wherein said interengaging means comprises:

a first set of adjacent ridges on said first housing half having a depression between adjacent ridges, the apexes of said ridges pointing in a direction parallel to said axis of rotation;

a second set of adjacent ridges on said second housing half adjacent the apexes of said ridges having a depressions between adjacent ridges extending parallel to said axis of rotation and being received in the depressions of the first set of ridges when said housing halves are in their first position, the depressions of said second set of ridges receiving the apexes of the first set of ridges.

24. The hinge according to claim 23 wherein said first and second sets of ridges and depressions are mating teeth.

25. The hinge according to claim 24 wherein said cam is made of nylon and further includes a lever to facilitate manual movement between its first and second position.

26. The hinge according to claim 25 wherein said positioning means comprises:

formations on an outer surface of one of said housing halves for engaging a stop block; and a stop block movably mounted to the other of said housing halves, said stop block movable between said first and second positions.

27. The hinge according to claim 26 wherein said stop block is mounted to a spring steel member extending from said other housing half, said spring steel member biasing said stop block into its first position.

28. A multi-purpose ladder capable of assuming a plurality of configurations comprising at least two ladder portions each having first and second stringers and a plurality of rungs; the respective first and second stringers of each ladder portion being connected by the hinge of claim 19 to facilitate pivotal movement of said stringers about a pivot axis and to releasably lock said ladder portions in any one of the plurality of angular relationships therebetween.

* * * * *